US012746432B2

(12) United States Patent
Jung

(10) Patent No.: US 12,746,432 B2
(45) Date of Patent: Sep. 29, 2026

(54) INSPIRATION EXERCISING AND PROMOTING DEVICE

(71) Applicant: Alexandre Jung, Lajeado (BR)

(72) Inventor: Alexandre Jung, Lajeado (BR)

( * ) Notice: Subject to any disclaimer, the term of this patent is extended or adjusted under 35 U.S.C. 154(b) by 176 days.

(21) Appl. No.: 18/709,788

(22) PCT Filed: Nov. 16, 2022

(86) PCT No.: PCT/BR2022/050441

§ 371 (c)(1),
(2) Date: May 13, 2024

(87) PCT Pub. No.: WO2023/087087

PCT Pub. Date: May 25, 2023

(65) Prior Publication Data

US 2025/0001251 A1 Jan. 2, 2025

(30) Foreign Application Priority Data

Nov. 17, 2021 (BR) ..... 1020210230525

(51) Int. Cl.
*A63B 23/18* (2006.01)
*A63B 21/02* (2006.01)

(52) U.S. Cl.
CPC ..... *A63B 23/18* (2013.01); *A63B 21/023* (2013.01)

(58) Field of Classification Search
CPC ... A63B 21/023; A63B 21/4003; A63B 23/18; A63B 23/025; A63B 23/03; A63B 23/032; A63B 2209/00; A61B 5/486; A61B 5/093; A61B 5/091; A61B 5/097
See application file for complete search history.

(56) References Cited

U.S. PATENT DOCUMENTS

| | | | | |
|---|---|---|---|---|
| 4,327,740 | A | 5/1982 | Shuman | |
| 4,345,605 | A | 8/1982 | Gereg | |
| 4,441,506 | A | 4/1984 | McCombs et al. | |
| 4,473,082 | A | 9/1984 | Gereg | |
| 4,628,916 | A | 12/1986 | Lerman et al. | |
| 4,870,962 | A * | 10/1989 | Sitnik | A61M 16/0084 128/205.24 |
| 5,647,345 | A | 7/1997 | Saul | |
| 8,161,966 | B2 * | 4/2012 | Foley | A61B 5/0836 128/200.12 |
| 2015/0011363 | A1 | 1/2015 | Foley et al. | |

FOREIGN PATENT DOCUMENTS

| | | |
|---|---|---|
| AU | 5112279 A | 4/1981 |
| EP | 0027154 B1 | 6/1983 |

* cited by examiner

*Primary Examiner* — Megan Anderson
(74) *Attorney, Agent, or Firm* — MUNCY, GEISSLER, OLDS & LOWE, P.C.

(57) ABSTRACT

An inspiratory incentive and exerciser device made of paper. This device is designed to be used as a respiratory incentive, applied to performing respiratory incentive exercises and inspiration exercises for users who require increased tidal volume and inspiratory muscle strengthening. This is a very common situation in daily respiratory physiotherapy practice, both in pre-operative and post-operative training.

12 Claims, 21 Drawing Sheets

INSPIRATION EXERCISING AND PROMOTING DEVICE

FIELD OF APPLICATION

This invention applies to the field of medical devices. This invention describes a disposable paper inspiratory incentive and exercise device.

FOUNDATIONS OF THE INVENTION

Respiratory incentives, as defined, are devices of various shapes, types, and materials that stimulate the performance of increased tidal volume, used in Respiratory Physiotherapy, as a stimulator of respiratory exercise through forced, active inhalations.

In the 1960s/1970s, exercises indicated by health professionals for patients with long hospital stays, using respiratory incentives, were common in hospitals and clinics. In a crafty manner, using an IV kit, a glove, and tape, the incentive device was assembled, and the user was instructed to "fill the glove with air" by blowing forcefully against the latex glove's resistance.

Nowadays, the models used in Brazil are mostly devices with a transparent acrylic body, with or without spheres, attached to a flexible tube and a plastic mouthpiece, in a way that stimulates the user's inspiratory increment. It is important to note that these devices are for single use, meaning one device per user, and are not sterilizable, generating a high cost for physiotherapeutic care.

Inspiratory Exercisers are defined as devices that perform a variable resistance of an airflow for training—strengthening of the increase in inspiratory muscle mass, in users with proven loss or need for increased inspiratory muscle strength.

Given this scenario, the present invention provides a solution to the current state of the art through an inspiratory incentive and exerciser device made of paper with folds, recyclable, low-cost, anti-infection, for performing respiratory incentive exercise and inspiratory exercises in users who need increased tidal volume and inspiratory muscle strengthening—a very common situation in daily respiratory physiotherapy practice—both in pre-operative or post-operative training, as well as during long-term hospitalization.

One of the advantages of this device is that it has folds, providing aid to the physiotherapy professional, encouraging the user to perform inhalations against the resistance of the paper box folds, thus contracting the inspiratory muscles of the thoracic cage, exercising in a repetitive manner and resulting in an increase in inspiratory strength.

Another advantage of this device is its low cost, which meets an urgent need of pulmonary rehabilitation professionals—including physiotherapists—as well as users of these products, especially due to the high cost of devices available on the market compared to the reimbursement of fees paid to physiotherapists.

Additionally, the device of the present invention, with its lower production and acquisition cost, achieves the same results as more complex equipment, which gives the device an important competitive edge.

STATE OF THE ART

The North American document U.S. Pat. No. 4,473,082 reveals a device to be used as a respiratory exerciser and for measuring air volume that has a bellows formed by a series of plastic bags with folds, featuring a fitting in its upper part that allows the passage of air, having a tray at its bottom that supports the bellows and a U-shaped hook that joins the tray to the upper part of the bellows, allowing the tray to rise and fall according to the use of the device.

The document disclosed distances itself from the present invention as it pertains to an inspiratory incentive and exerciser device for therapy of users in rehabilitation who need to exercise their pulmonary musculature and stimulate the respiratory system for gradual breathing capacity enhancement. The invention does not have markers to determine the volume of air inhaled because its scope focuses on a series of respiratory system exercises. The device in the North American document consists of a series of plastic bags with folds, which aim to confer greater durability to the device and, at the same time, offer greater or lesser resistance in use depending on the number of layers; it also has a U-shaped hook that allows the tray to rise and fall according to the use of the device. The positioning of this device for use is vertical. The device of the present invention has a unique and different design from the previously described device, being made of a single body entirely of paper with variable grammages depending on the desired resistance level for the exercises, organized from overlapping folds with airtight sealing of both ends and joined by gluing at the point of its junction with the base. Therefore, the device of the present invention is characterized by being lightweight and easy to handle by anyone; it has an upper front face orifice that allows for the optional introduction of a paper mouthpiece fitted in place for greater user convenience; it has variable resistance according to the paper grammage used in its manufacture; it is disposable and environmentally friendly; it allows for low-cost production and widespread sale at an affordable price, enabling purchase by different consumer brackets. Additionally, the device of the present invention does not have internal tubing to provide a different flow.

The device of the present invention stimulates the user to exercise through the movement of the folds themselves so that, when inhaling air through the optional mouthpiece or directly from the existing orifice on the front face of the device, the folds of the bellows, as per the exerted inspiratory force, serve as a visual stimulus for respiratory training. This device is also intended for use by athletes or anyone, with its size and natural resistance dictated by the device according to the grammage of the paper used, suitable for the characteristics of the user's pulmonary system, whether adult or child.

The North American document U.S. Pat. No. 4,441,506 refers to a respiratory exerciser device with an articulated bellows design and a box that opens and closes according to the air blown by the user. The box and the bellows are constructed in a way that the hose and mouthpiece are stored inside the box. The respiratory apparatus of the invention comprises a bellows attached to the tray portion of a box-shaped structure which also includes a hinged lid on one edge connected to the tray portion with a pair of triangular braces. The box, including the tray portion, the lid, and the braces, is made of cardboard. The bellows is effectively a separately manufactured sub-assembly that is glued into the box, as will be described in more detail below. The bellows is essentially an assembly made with tape and glue from flat cut pieces made of cardboard or a similar material. The sheet material is folded in a specific manner to provide an airtight bellows while being resistant to tears or deterioration due to repeated use.

What is revealed by this document is distinct from the present invention, as it does not describe a simplified inspiratory incentive and exerciser device made entirely of paper, for the therapy of users in rehabilitation—both adults and children—who need to exercise their pulmonary musculature, and equally serves athletes who aim to stimulate the respiratory system for a gradual increase in respiratory capacity. The device of the present invention lacks any tubing or internal space for housing hoses and mouthpieces, or external hoses and plastic mouthpieces, nor does it have a system to provide different airflow, as well as it dispenses with any kind of parts for the functionality of the device, such as opening limiters, gauges, mechanical joints, or other complex apparatuses as found in the previously mentioned document's device. Moreover, normal use of the device disclosed by this document may result in the saturation of residues deposited inside, generating cultures of bacteria and other contaminants, which does not occur with the present invention that is disposable, made of non-contaminant and environmentally friendly material, and comes assembled and ready to use, requiring only that the user optionally fits the cylindrical paper mouthpiece into the front orifice for greater convenience in exercise practice. The device of the present invention features adjustable resistance according to the grammage of the paper used in its manufacture, which can imply greater or lesser resistance as per medical or physiotherapist guidance to meet the respiratory training needs, given that each pathology requires a specific type of exercise. Due to the exclusive use of paper in its composition, which is low cost, it enables large-scale production for sale at an affordable price to the end consumer.

The North American document US 2015/0011363 refers to a respiratory muscle resistance training device consisting of an adjustable chamber that adjusts between at least a first and a second internal volume, where this adjustable chamber includes an exit end; and a user interface connected to the end of the said chamber's exit. It also has an entry end and a one-way inhalation valve located near the entry end of the said chamber and a one-way exhalation valve with an entry end near the proximal end of the said chamber. The chamber may have a flexible bellows form.

The North American document U.S. Pat. No. 4,327,740 refers to a volume-type incentive spirometer device for respiratory therapy. The spirometer includes a central tubular support on which a foldable chamber similar to a bellows is mounted. This spirometer has four main components: a rigid tubular support member, a foldable inspiration volume measurement chamber surrounding the support, a base to hold the support, and a fluid conduit ending in a mouthpiece to provide fluid communication between the spirometer and the user. The foldable inspiration volume measurement chamber has a bellows form and is attached to the upper end of the tube, and this chamber has a rigid top plate and a lower surface that has an orifice where the tube is fitted. The chamber also includes a continuous and foldable tubular side wall that is imperforate and sealed at its top to the lower surface of the plate. The dimensions of the device in this document are not disclosed.

Both documents cited differ from the device of the present invention, which has a unique shape, due to the greater complexity in the assembly and structure of its components arranged to enable use, especially by utilizing plastic materials whose disposal requires care, particularly due to the risk of contaminants developed in their bodies or ducts and mouthpieces of the equipment. The advantages of the device of the present invention are its simplicity and practicality, which is ready for use upon opening the packaging, eliminating the need for assembly. Being made entirely of paper, the device of the present invention can be disposed of immediately after each daily exercise session.

SUMMARY OF THE INVENTION

The present invention describes a disposable paper inspiratory incentive and exerciser device. This device serves as a respiratory incentive used to perform respiratory incentive exercise and inspiration exercises in users who require increased tidal volume and inspiratory muscle reinforcement—a very common situation in daily respiratory physiotherapy practice, both in pre-operative or post-operative training, as well as during prolonged hospitalization.

DETAILED DESCRIPTION OF THE INVENTION

Figure 1:
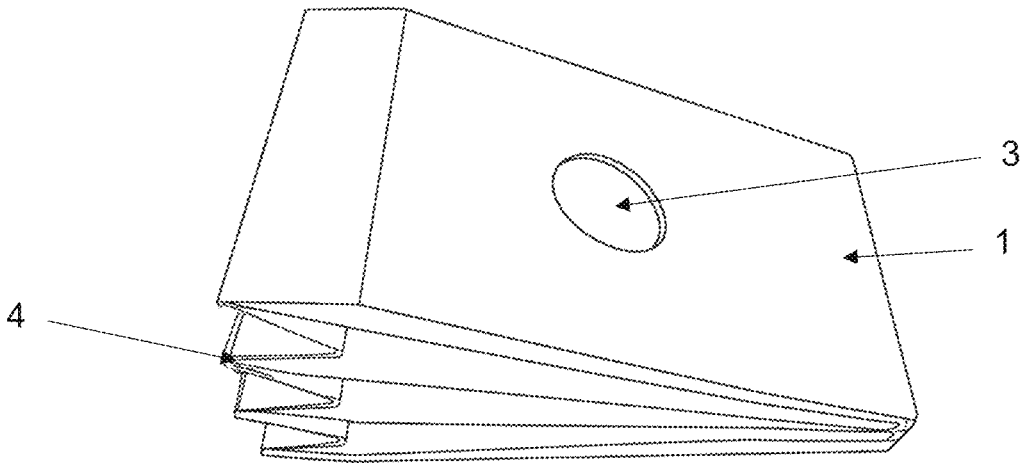
FIGS. 1 to 7 show the views of the inspiratory incentive and exerciser device in its rectangular form.
Figure 2:
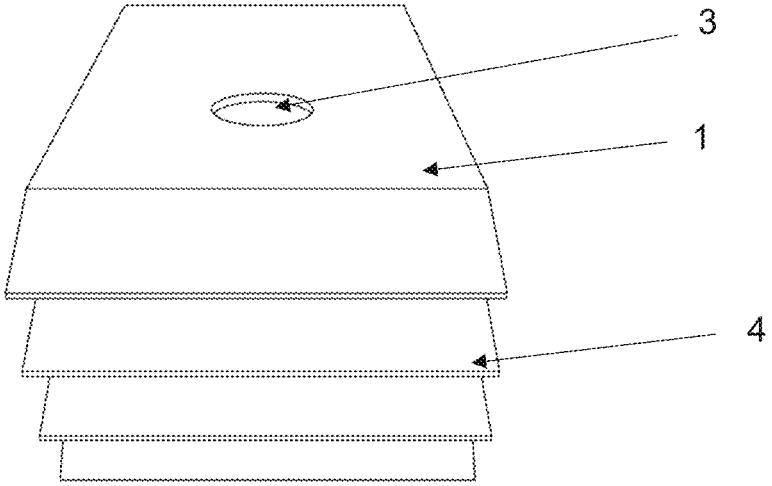
Figure 3:
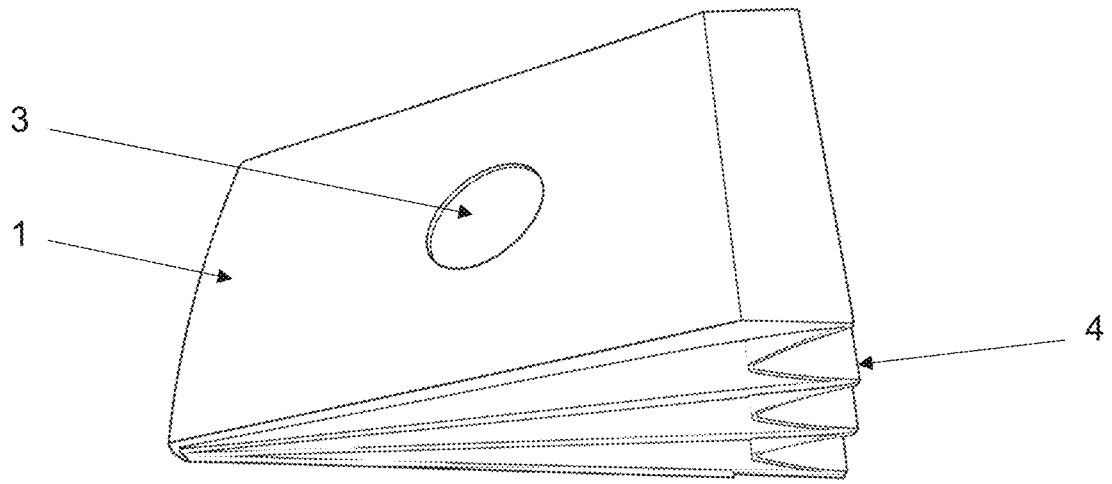

The present invention describes a disposable and environmentally friendly paper inspiratory incentive and exerciser device, allowing for low-cost production and large-scale sales at affordable prices, enabling acquisition by different consumer segments. This device is intended to be used as a respiratory incentive for performing respiratory incentive exercises and inspiration exercises in users who require increased tidal volume and inspiratory muscle strengthening—a common situation in daily Respiratory Physiotherapy practice, both in pre-operative and post-operative training, as well as during prolonged or long-term hospitalizations.

The described inspiratory incentive device includes an accordion-like structure consisting of a set of vertical and horizontal folds with angles ranging from 35° to 110°. These can have all sides accordioned or one fixed side, forming a bellows made of accordioned folds (4), which have angled folds, creating a set of parallel lines with vertical creases that make up the columns, and in conjunction with the horizontal lines, give specific shapes to the folds, defining the dimensions of the said device. The vertical lines with the angled folds cause the paper to retract—reducing the total size of the device and forming the bellows—with a posterior body (2) having variable dimensions from 30 mm to 200 mm, which closes the device at its lower end and supports the bellows, and an anterior body (1) with the same dimensions as the posterior body, which closes the device at its upper end. It has an orifice (3) with a diameter varying between 10 mm and 40 mm that allows the passage of air, the device being made of a flexible material, preferably paper.

Figure 8:
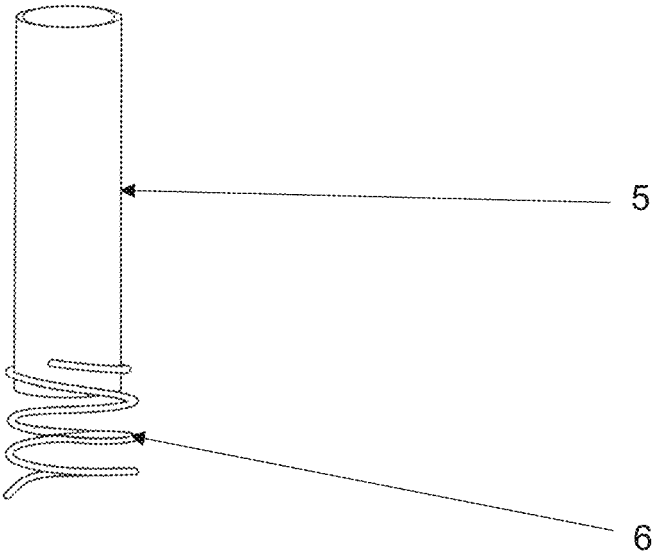
FIG. 8 shows the mouthpiece with an attached spring.

In an alternative mode, a mouthpiece (5) with a diameter ranging between 10 mm and 40 mm is attached to the orifice (3) of the device. FIG. 8 shows the mouthpiece with an attached spring, and FIG. 9 displays the technical drawing of the die-cut and its legend. The technical drawing of the die-cut offers the possibility of making two sizes of mouthpiece: 20 mm and 30 mm, as marked and according to the needs of the user. Preferably, the mouthpiece (5) is made from the same paper as the device.

The described device can have multiple dimensions and shapes, comprised of unique accordion folds (4) tailored to the form and size of the device, which result in the expansion and contraction of its original size prior to use as they are subjected to the inspiratory force applied by the user.

The accordion folds (4) create a set of parallel lines with vertical creases that form columns, positioned on the outside of the device. Together with the horizontal lines, they shape the specific folds, defining the dimensions of the device. The vertical lines with angled folds cause the paper to retract—reducing the overall size of the device and forming the bellows—with a closure on the posterior body (2), with variable dimensions from 5 mm to 250 mm, giving the paper a unique accordion shape specific to each distinct geometry of the device. This, in turn, generates a certain resistance that will be greater or lesser depending on the paper's grammage, ranging from 120 g/m2 to 300 g/m2. The paper can be selected from a group including bond paper, recycled paper, duplex, triplex, cardboard, kraft, or any other paper suitable for the graphic creasing technique, as well as the sizing of the orifice (3) and the user's treatment needs. Thus, the type of paper and its grammage play a primary role in forming the body of the device, generating specific resistance from the unique arrangement of its folds, and based on the layout and the opening of the orifices (3), increase or decrease the effort required for inspiration in a specific series of exercises. The closure of the posterior body (2) of the device is made with paper folds, creases, and glue.

The device can be manufactured in different shapes, the main ones being square, rectangular, triangular, and pentagonal. Each different shape implies a characteristic distance between the anterior body (1) and the posterior body (2) and the number of accordion folds (4) that will act according to the inspiratory force exerted by the user, causing constriction and widening of the device body and consequent reduction and increase in its total size from 5 mm to 250 mm.

The accordion folds (4) forming the bellows have a proportionality, which is a space opening for two folds, meaning that with the accordion closed, each fold will have half the total distance in relation to the accordion opened, maintaining a proportionality of 1 space for every 2 folds.

The inspiratory incentive and exerciser device with a rectangular shape has total length dimensions varying between 5 mm and 250 mm, total width varying between 30 mm and 120 mm, and total height varying between 40 mm and 200 mm, with 5 mm to 100 mm distance between the accordion folds (4) in its bellows, maintaining a proportionality of 1 space for every 2 accordion folds (4); with a posterior body (2) that supports the bellows with width varying between 30 mm to 120 mm and height varying between 40 mm to 200 mm, and an anterior body (1) with width dimensions varying between 30 mm to 120 mm and height varying between 40 mm to 200 mm, and which has an orifice (3) with diameter varying between 10 mm to 40 mm. FIGS. 1 to 7 and 11 show views of the inspiratory incentive and exerciser device in its rectangular format.

The device with a square shape has total length dimensions ranging from 5 mm to 250 mm, total width from 40 mm to 120 mm, and total height from 40 mm to 120 mm; with a 5 mm to 100 mm distance between the accordion folds (4) in its bellows, maintaining a proportionality of 1 space for every 2 accordion folds (4). It features a posterior body (2) that supports the bellows with width dimensions varying between 40 mm and 120 mm, and height between 40 mm and 120 mm, and an anterior body with width dimensions also varying between 40 mm and 120 mm and height between 40 mm and 120 mm that has an orifice (3) with a diameter ranging from 10 mm to 40 mm. FIGS. 12 to 15 show the views of the inspiratory incentive and exerciser device in its square format.

The device with a triangular shape has total length dimensions ranging from 5 mm to 250 mm, total width from 40 mm to 140 mm, and total height from 50 mm to 160 mm; with a 5 mm to 100 mm distance between the accordion folds (4) in its bellows, maintaining a proportionality of 1 space for every 2 accordion folds (4). It features a posterior body (2) that supports the bellows with width dimensions varying between 40 mm and 140 mm, and height between 50 mm and 160 mm, and an anterior body (1) with width dimensions varying between 40 mm and 140 mm, and height between 50 mm and 160 mm that has an orifice (3) with a diameter ranging from 10 mm to 40 mm. FIGS. 16 to 20 show the views of the inspiratory incentive and exerciser device in its triangular format.

The device with a pentagonal shape has total length dimensions ranging from 5 mm to 250 mm, total width from 40 mm to 160 mm, and total height from 60 mm to 160 mm; with a 5 mm to 100 mm distance between the accordion folds (4) in its bellows, maintaining a proportionality of 1 space for every 2 accordion folds (4). It features a posterior body (2) that supports the bellows with width dimensions varying between 40 mm and 160 mm, and height between 60 mm and 160 mm, and an anterior body (1) with width dimensions varying between 40 mm and 160 mm, and height between 60 mm and 160 mm that has an orifice (3) with a diameter ranging from 10 mm to 40 mm. FIGS. 21 to 25 show the views of the inspiratory incentive and exerciser device in its pentagonal format.

Thus, when ready for initial use, the device should be at its largest size, as each new inhalation by the user will cause the device to retract in size and subsequently return to its initial state.

The repetition of inhalations performed by the user on the device causes an increase in tidal volume, while the decrease and increase in the size of the device serve to stimulate the user, proving the result of the exercise. The device refers to a low-cost production equipment accessible for purchase by any consumer, is recyclable, assists in post-operative treatment and reduction of pulmonary infection, is effective in increasing tidal volume, and serves for the training and strengthening of inspiratory muscles.

The device features an adjustable inspiratory force, determined through a combination of variables: the paper's grammage; the larger or smaller diameter of the orifice (3) on the anterior body (1) of the device, which can be adjusted by the user pressing a pre-existing perforation in the paper layout that will form the device on the front face of the anterior body (1), choosing between 10 mm to 40 mm, depending on the desired effort. The orifice (3) with a larger diameter, up to 40 mm, facilitates use in initial applications or for users with less strength. The intermediate diameter orifices, 30 mm, or the smallest diameter, 20 mm, are designed to increase the difficulty of using the device, requiring greater effort in inhalation. Thus, by simply adjusting the opening and/or closing of the orifice (3) of the device, it is possible to tailor the user's effort to the desired resistance according to their capacity and training needs. The perforations are made with die-cuts, represented in FIGS. 11, 12, 16, 21, and 26 to 29, which show the views of the technical drawing of the die-cut. They appear only on the unfolded paper that will form the device and serve as guidance for making the device's folds.

The repetition of inhalations performed by the user on the device results in an increase in tidal volume, while the reduction and expansion of the device's body serve to stimulate the user, proving the exercise's effectiveness.

The device is a low-cost production equipment accessible for purchase by any consumer, is recyclable, assists in pre and post-operative treatment, and reduces pulmonary infection, is effective in increasing tidal volume, and serves for the training and strengthening of the inspiratory muscles.

Figure 4:
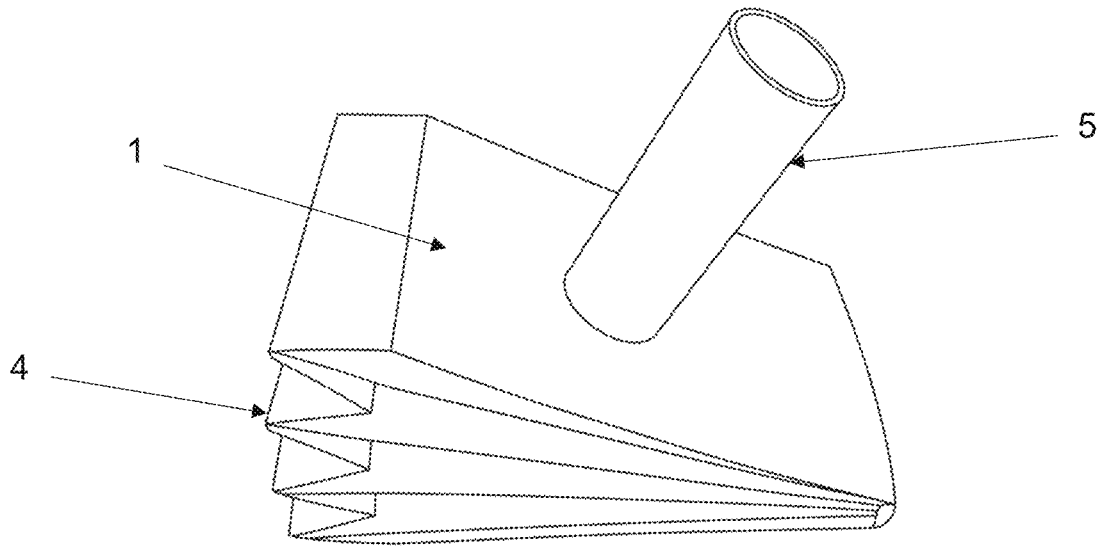
Figure 5:
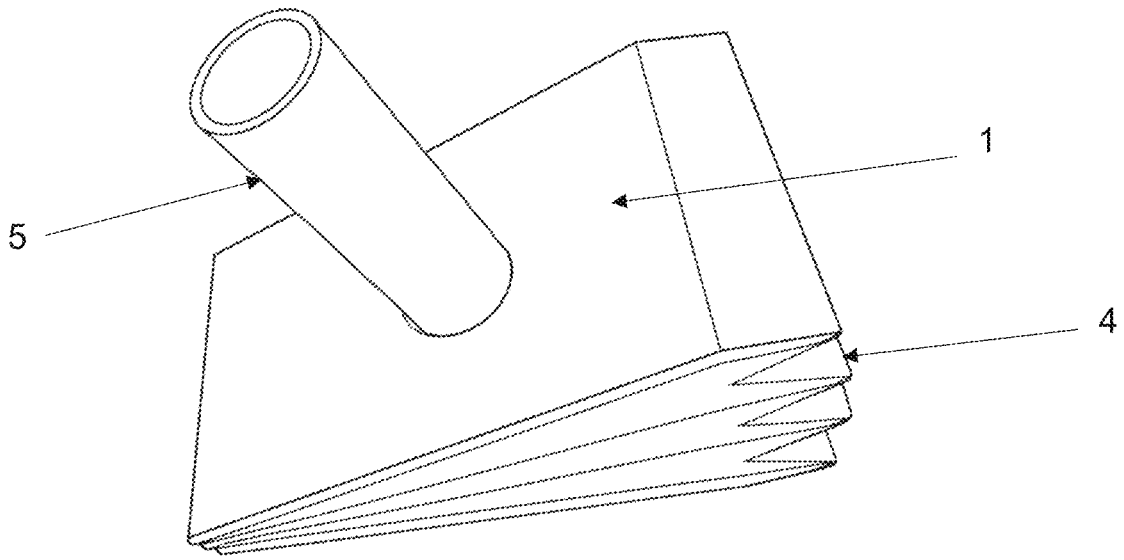
Figure 6:
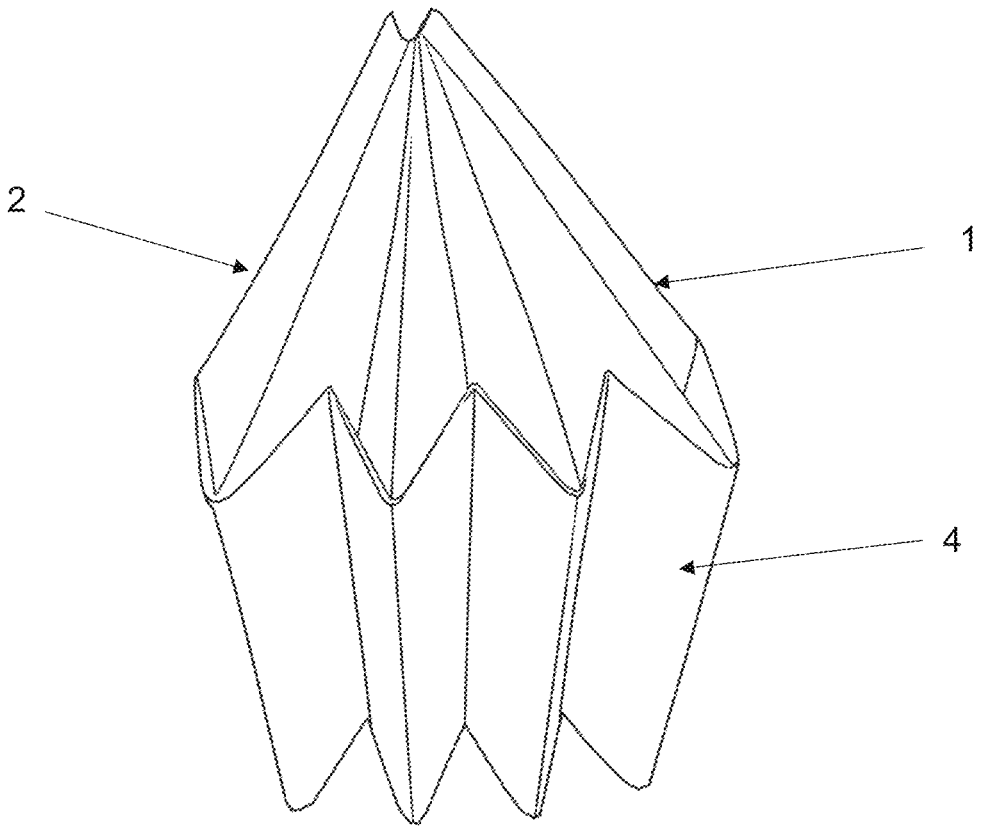
Figure 7:
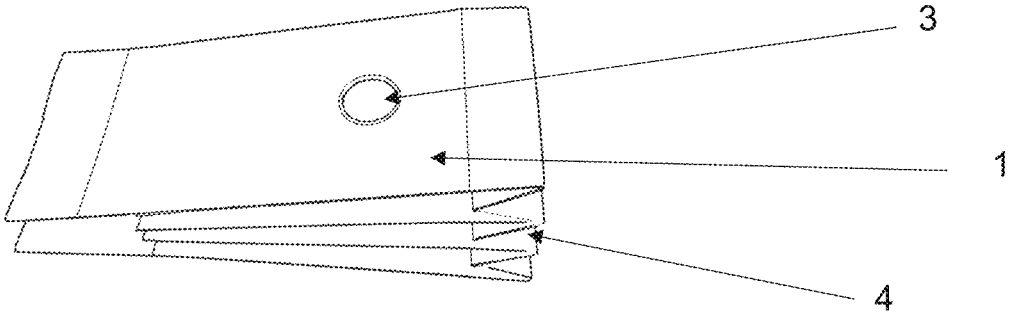

FIGS. 1 to 7 show the views of the inspiratory incentive and exerciser device in its rectangular form, with FIGS. 4 and 5 showing an optional mode where the mouthpiece (5) is attached to the orifice (3) of the device.

Figure 9:
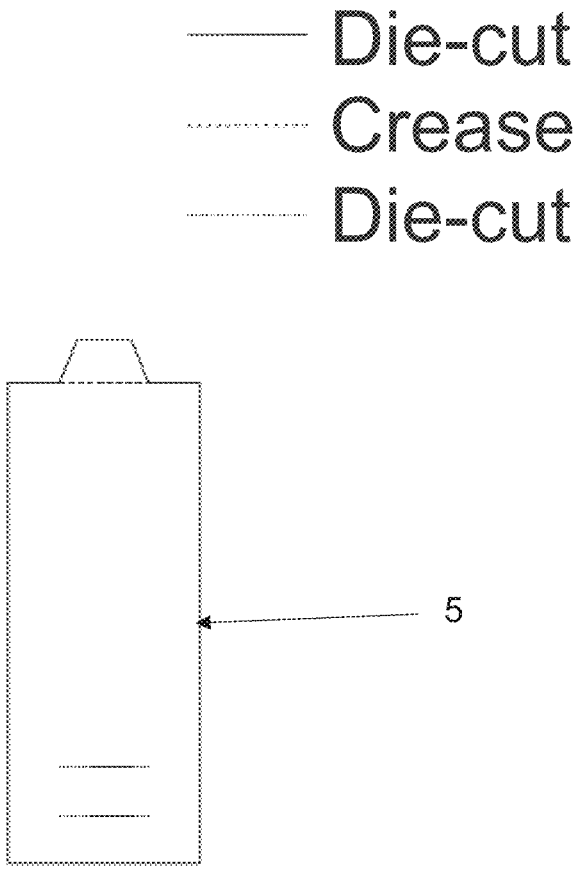
FIG. 9 shows the side view of the mouthpiece (see technical drawing).

In another alternative mode, as shown in FIGS. 8 and 9, the mouthpiece (5) has a linear helical spring (6) attached at its end that is connected to the device, providing greater resistance as the spring (6) will increase resistance and consequently increase the force the user must exert to achieve the total closing/shrinking movement of the device.

This device features a crucial characteristic of airtight closure to create negative pressure (vacuum) and consequent reduction in size during exercise (inhalation). The closure is achieved with paper folds, creases, and glue.

Figure 10:
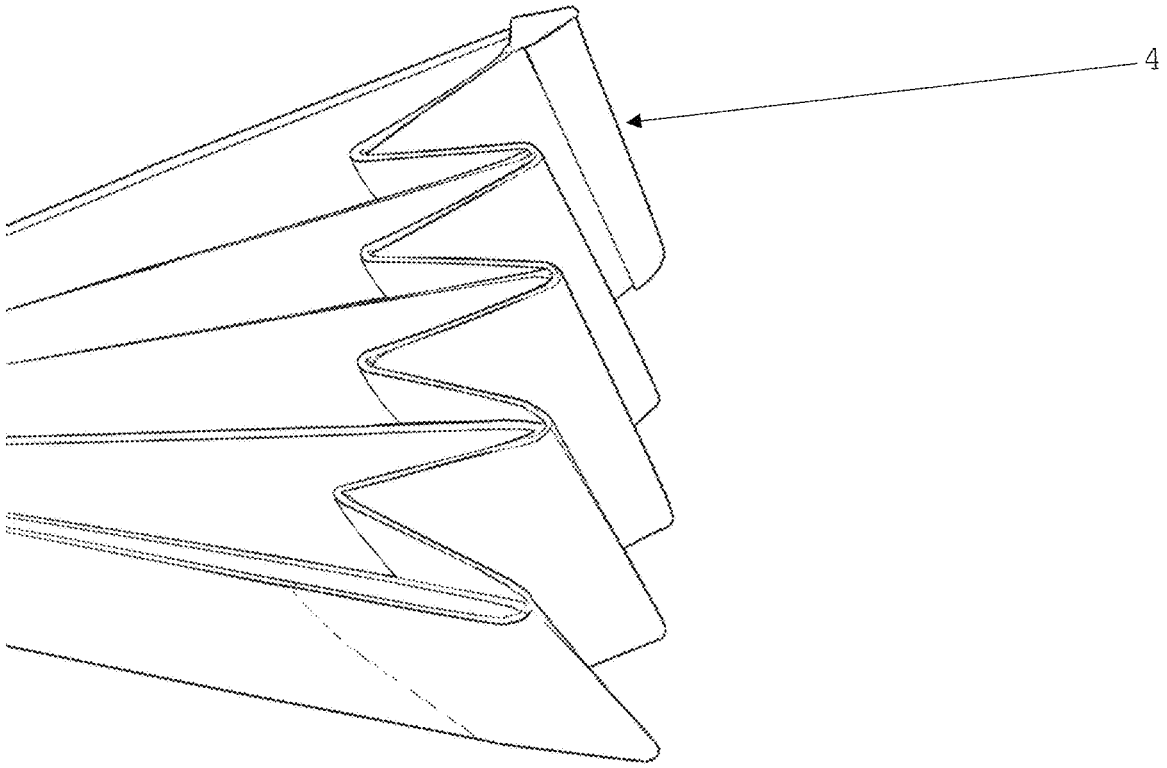
FIG. 10 shows the side view of the rear flap of the perceptive-type device.
Figure 11:
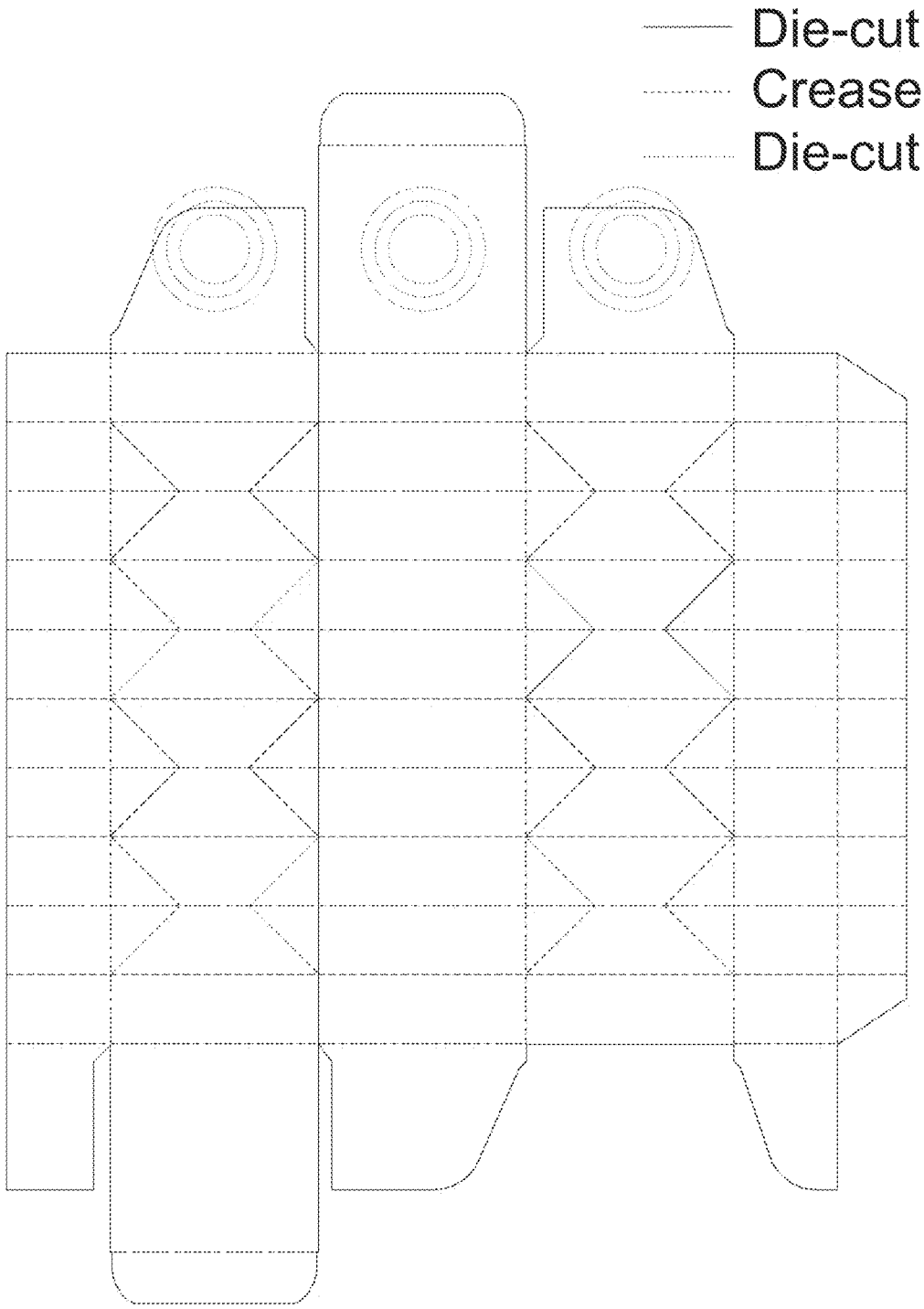
FIG. 11 shows the technical drawing of the die-cut for the device in a square shape.
Figure 12:
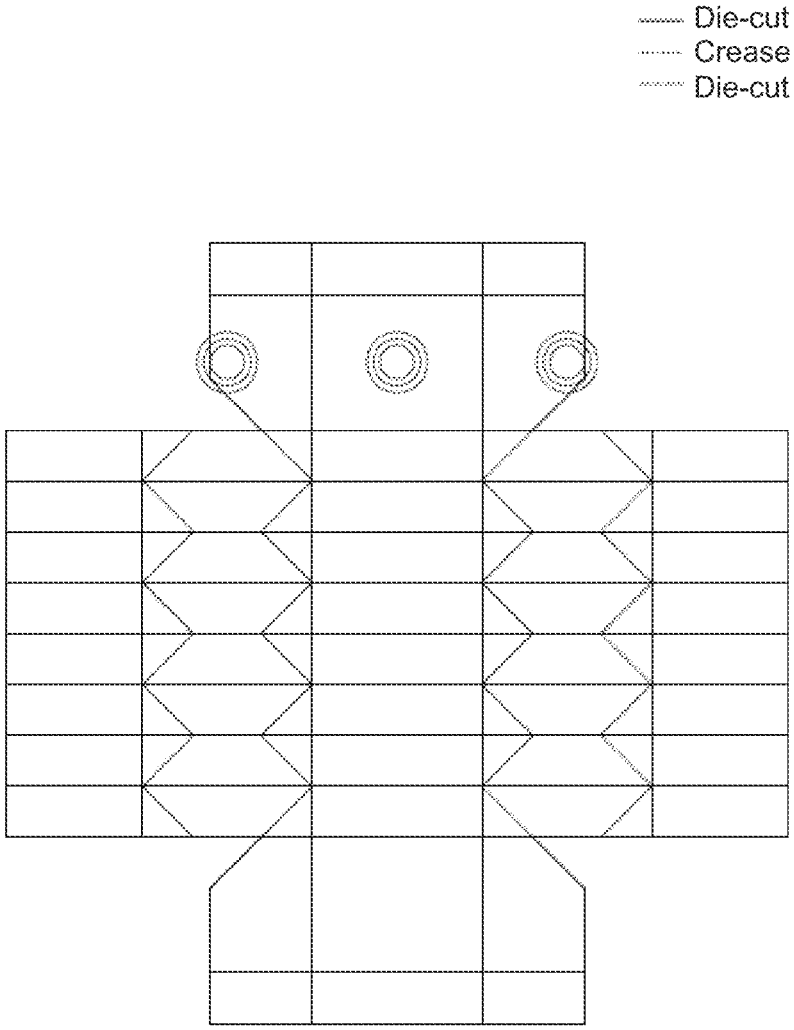
FIG. 12 shows the technical drawing of the die-cut for the device in a square shape.
Figure 13:
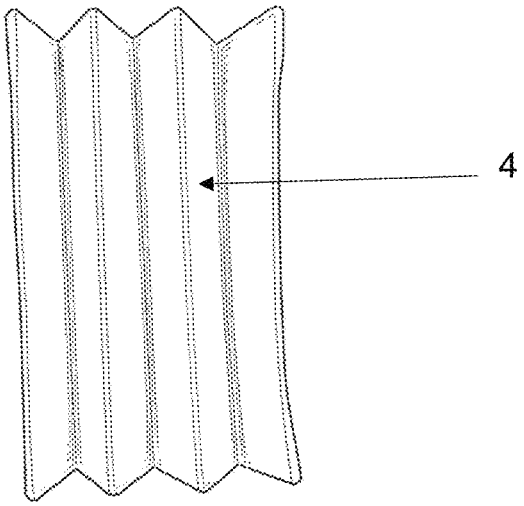
FIG. 13 shows a side view of the device in a square shape.
Figure 14:
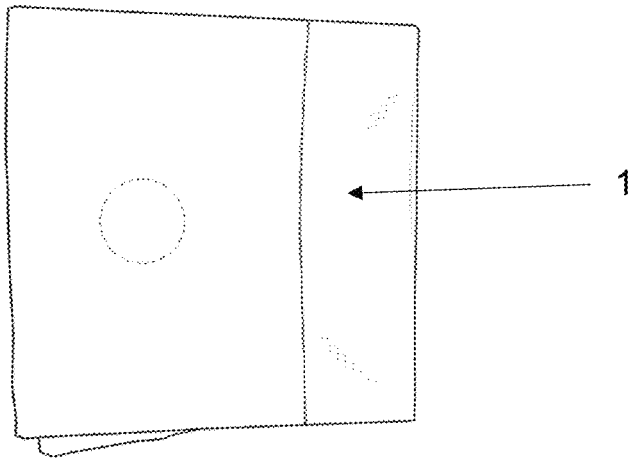
FIG. 14 shows the front view of the device in a square shape.
Figure 15:
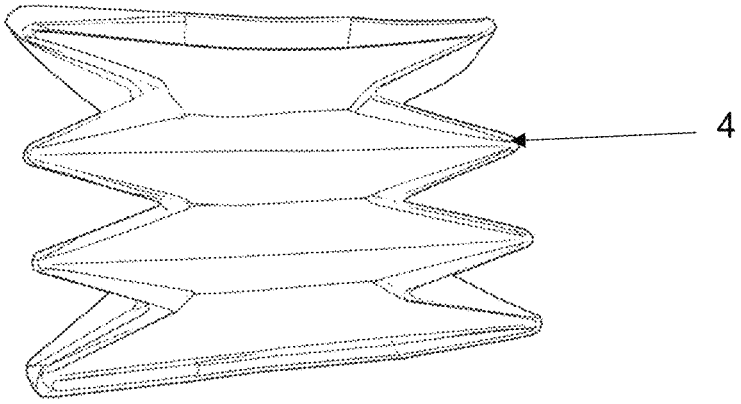
FIG. 15 shows a side view of the device in a square shape.
Figure 16:
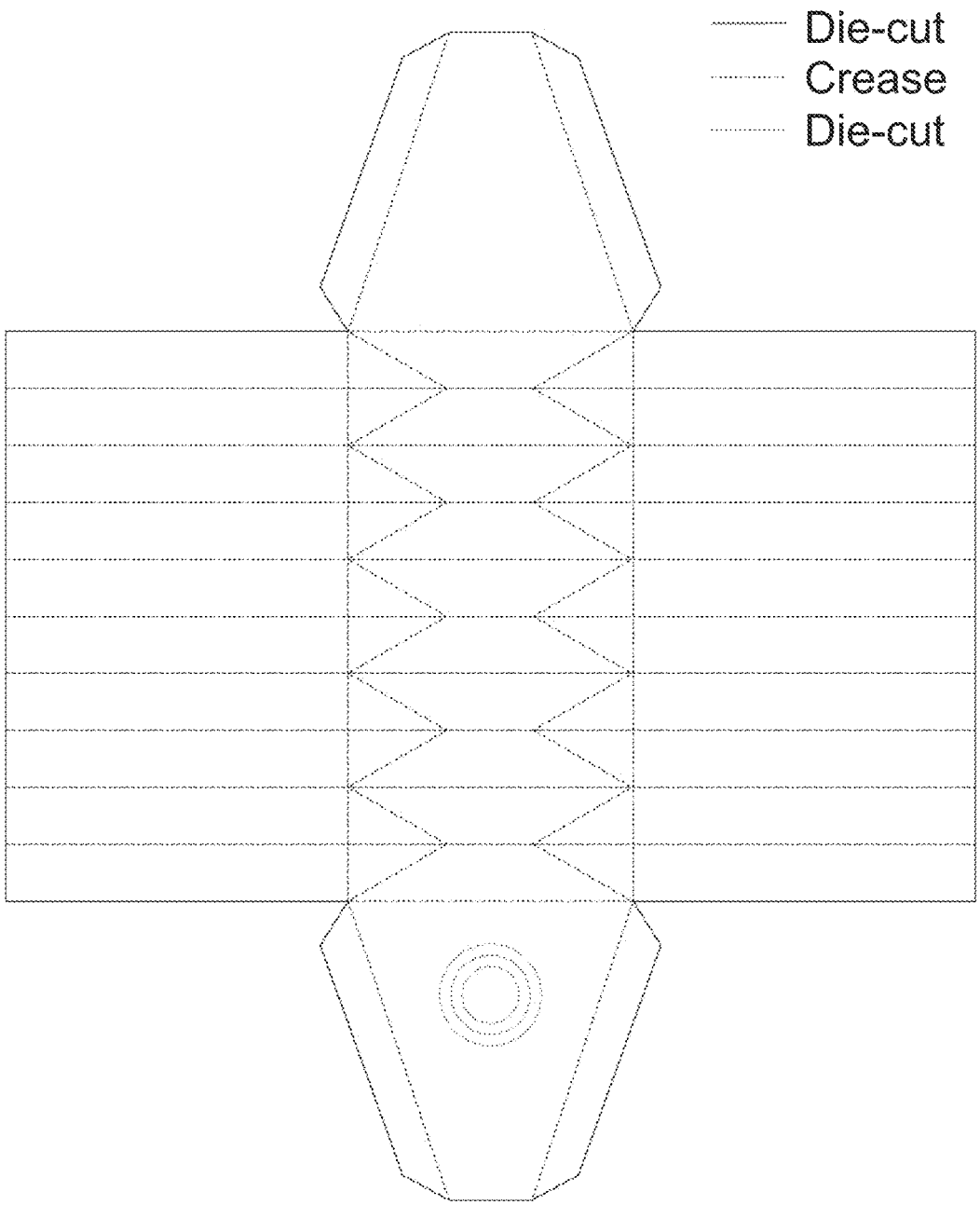
FIG. 16 shows the technical drawing of the die-cut for the device in a triangular shape.
Figure 17:
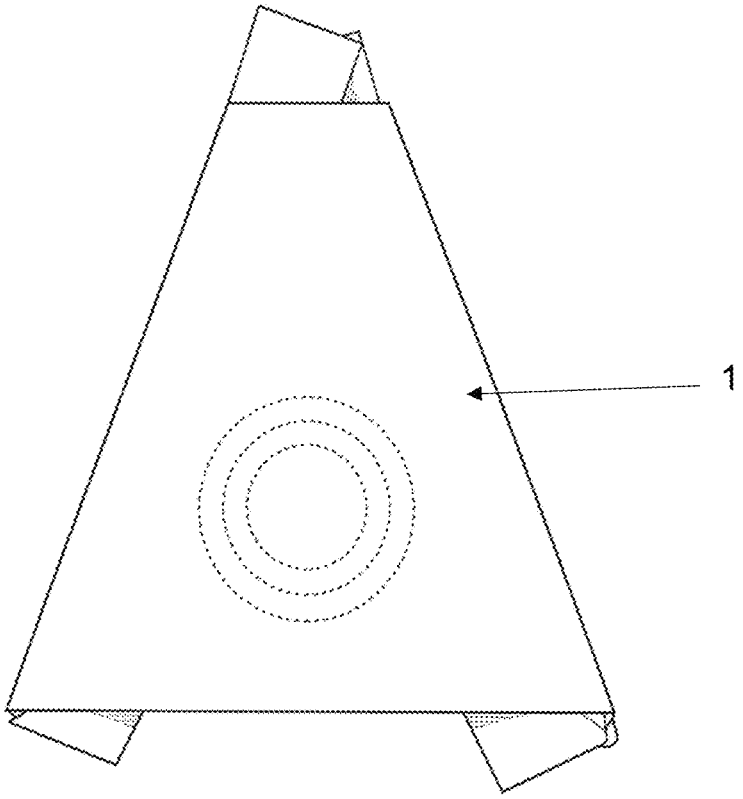
FIG. 17 shows the front view of the device in a triangular shape.
Figure 18:
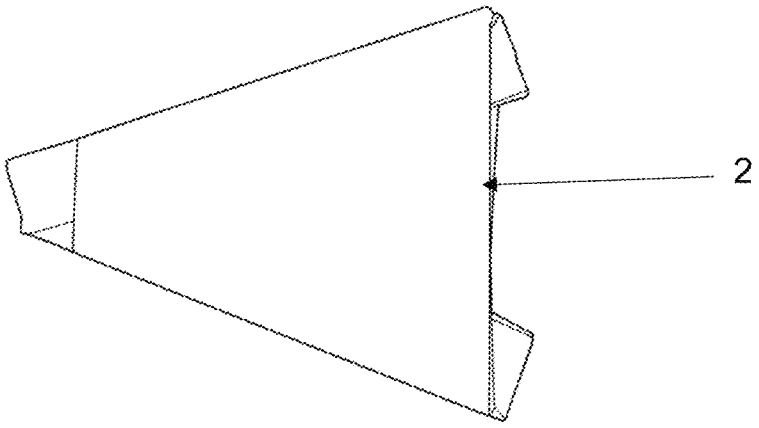
FIG. 18 shows the rear view of the device in a triangular shape.
Figure 19:
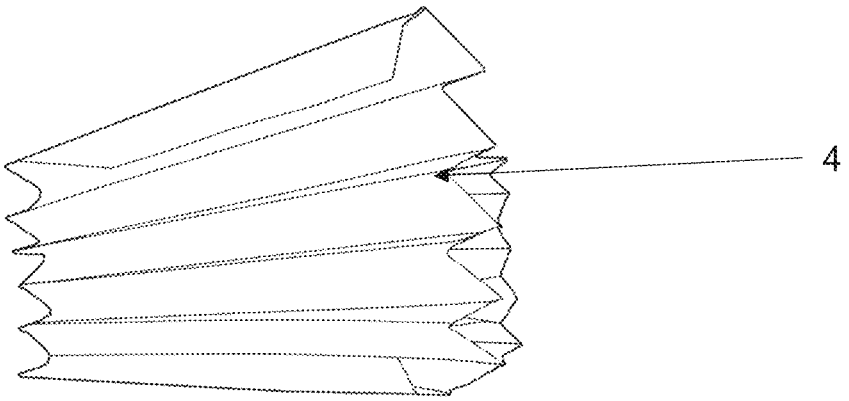
FIG. 19 shows the side view of the device in a triangular shape.
Figure 20:
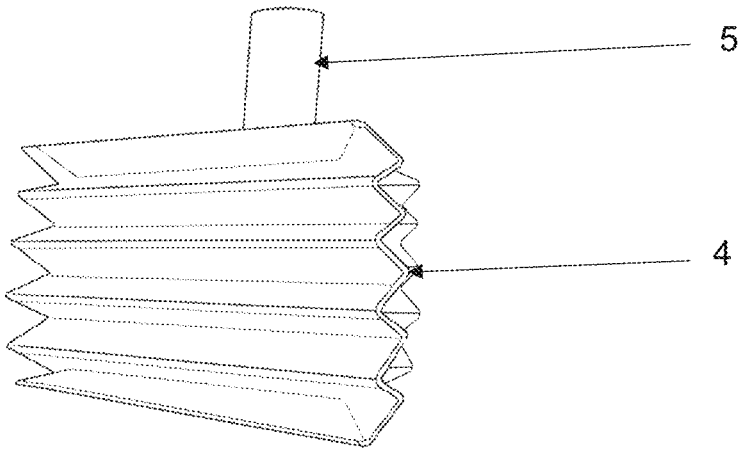
FIG. 20 shows the side view of the triangular-shaped device with a mouthpiece.
Figure 21:
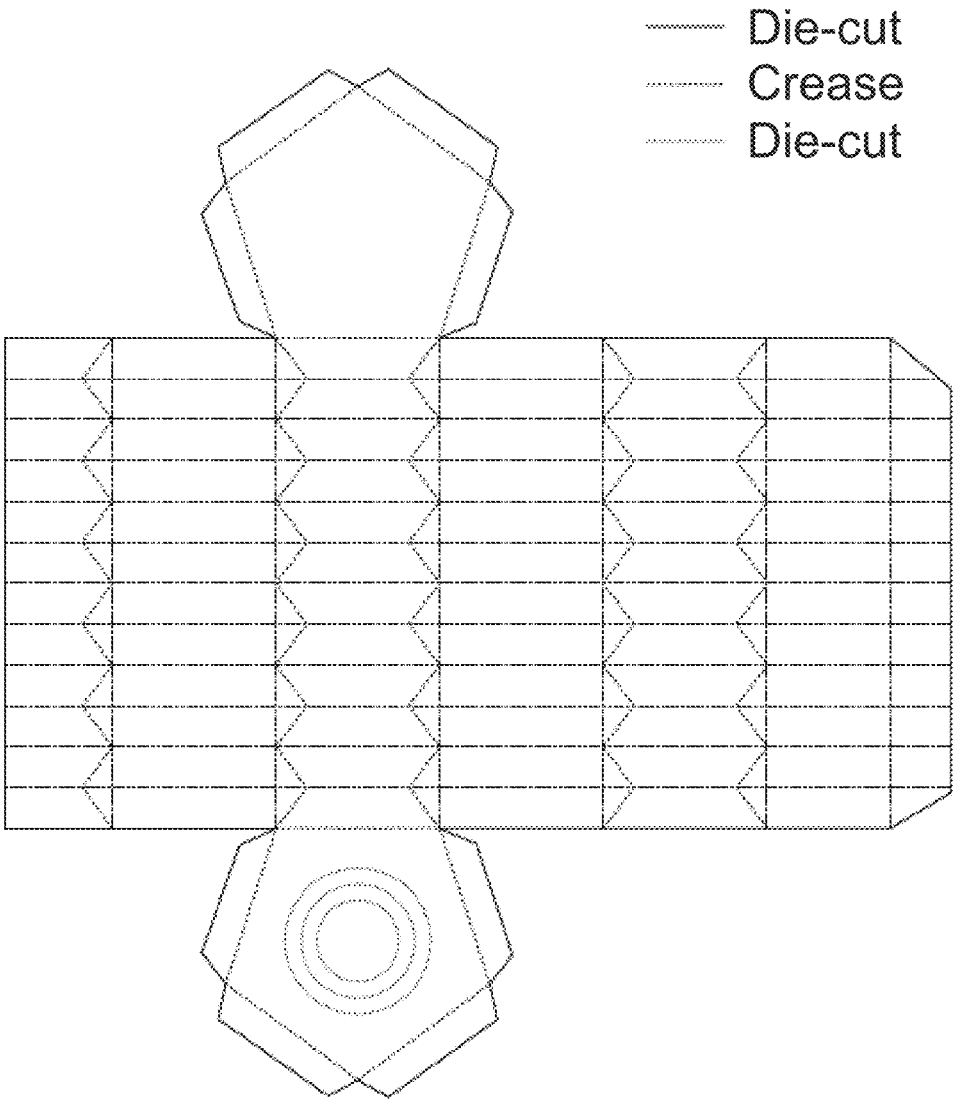
FIG. 21 shows the technical drawing of the die-cut for the device in a pentagonal shape.
Figure 22:
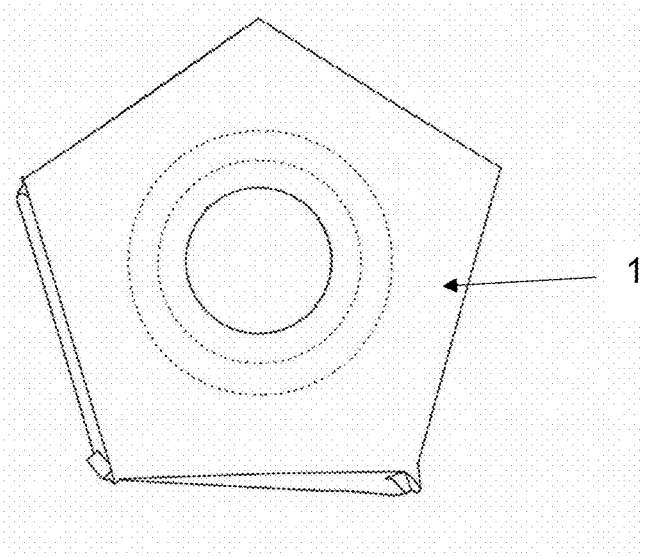
FIG. 22 shows the front view of the device in a pentagonal shape.
Figure 23:
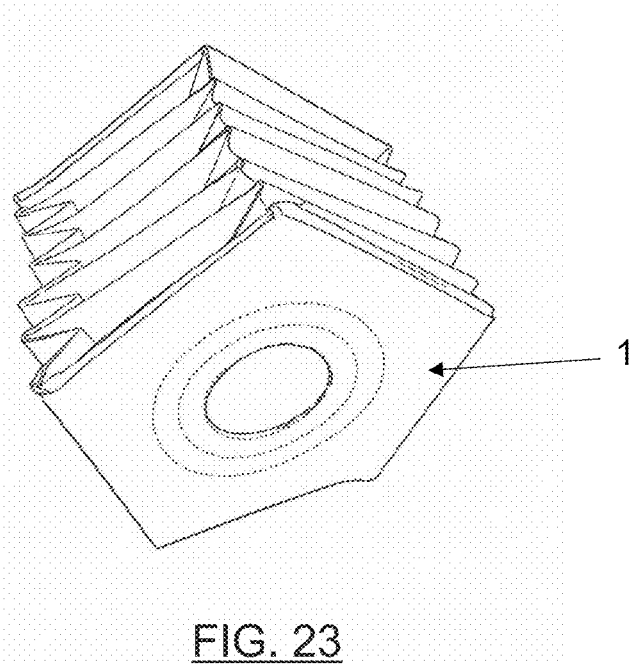
FIG. 23 shows the front perspective view of the device in a pentagonal shape.
Figure 24:
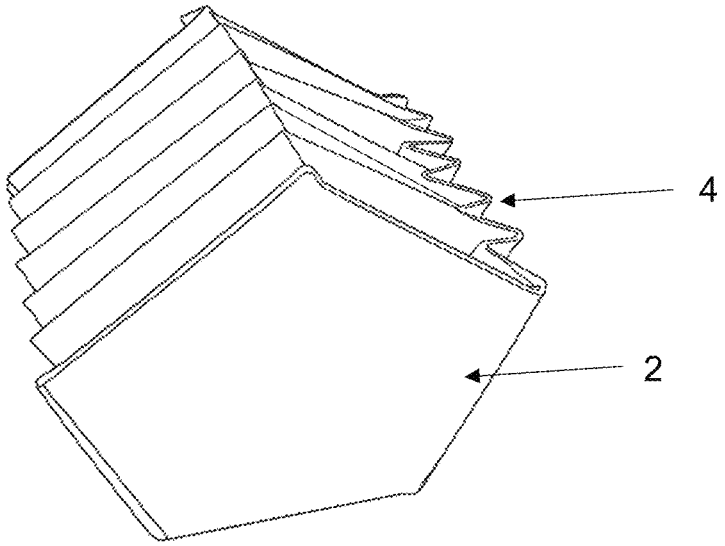
FIG. 24 shows the rear perspective view of the device in a pentagonal shape.
Figure 25:
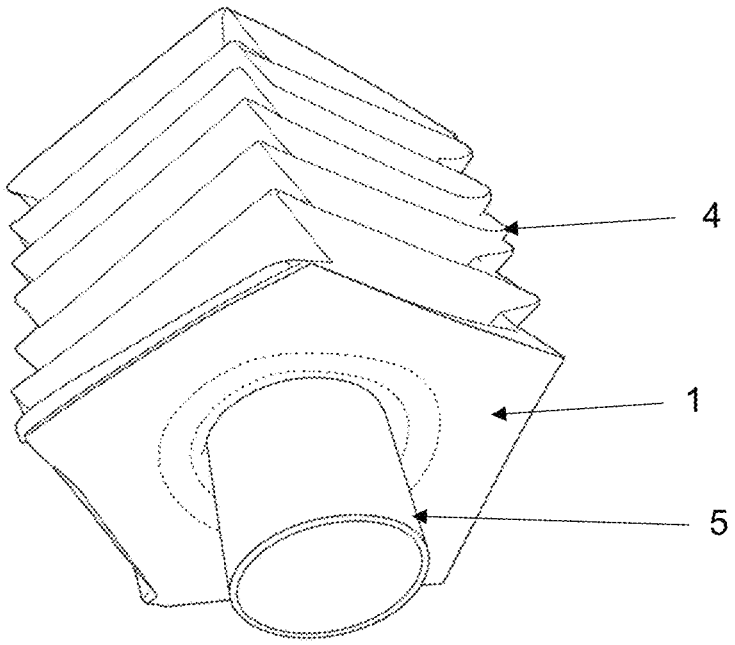
FIG. 25 shows the front perspective view of the pentagonal-shaped device with the mouthpiece.
Figure 29:
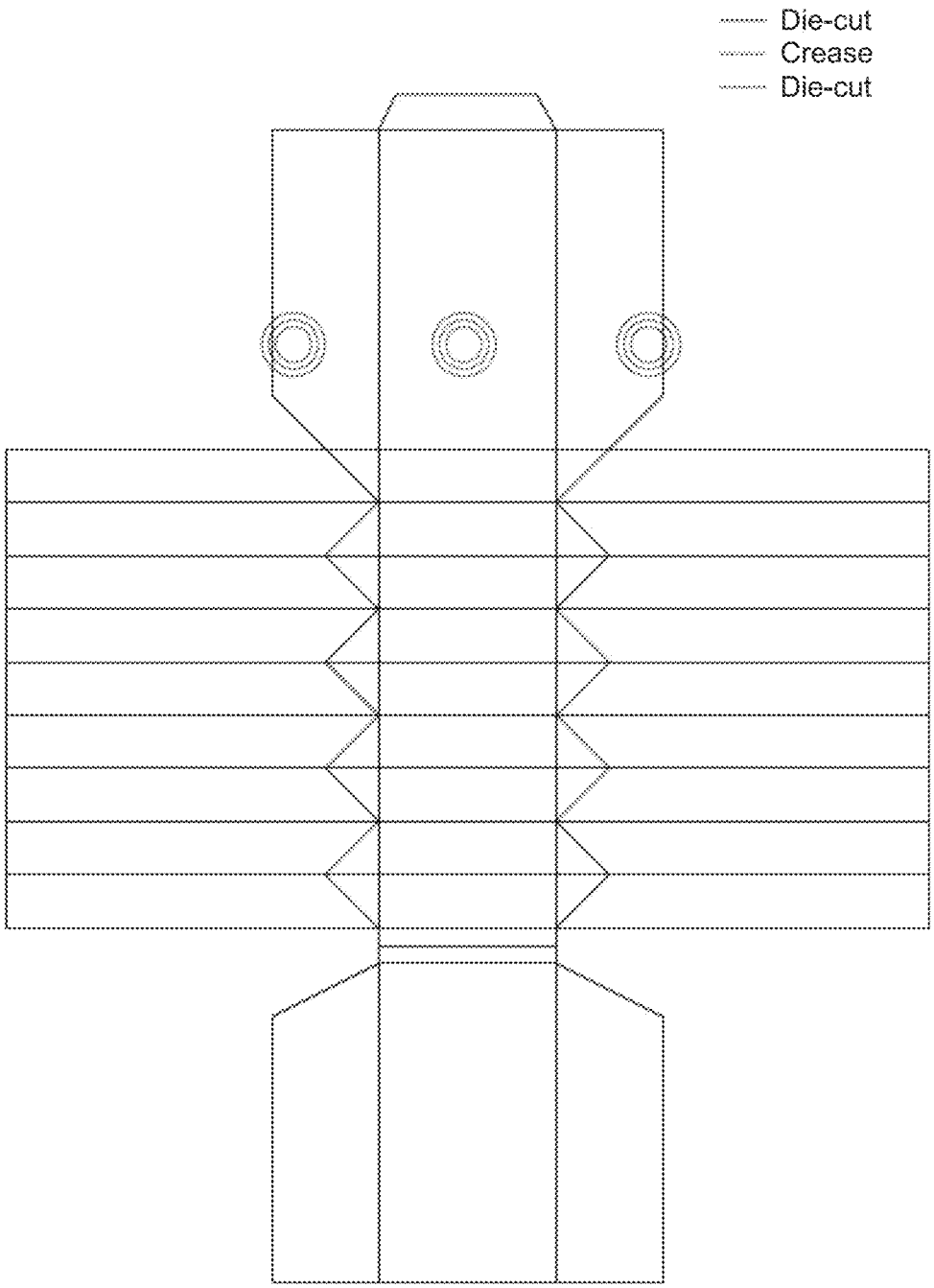
FIG. 29 shows the technical drawing of the perceptive type for the rectangular device.
Figure 30:
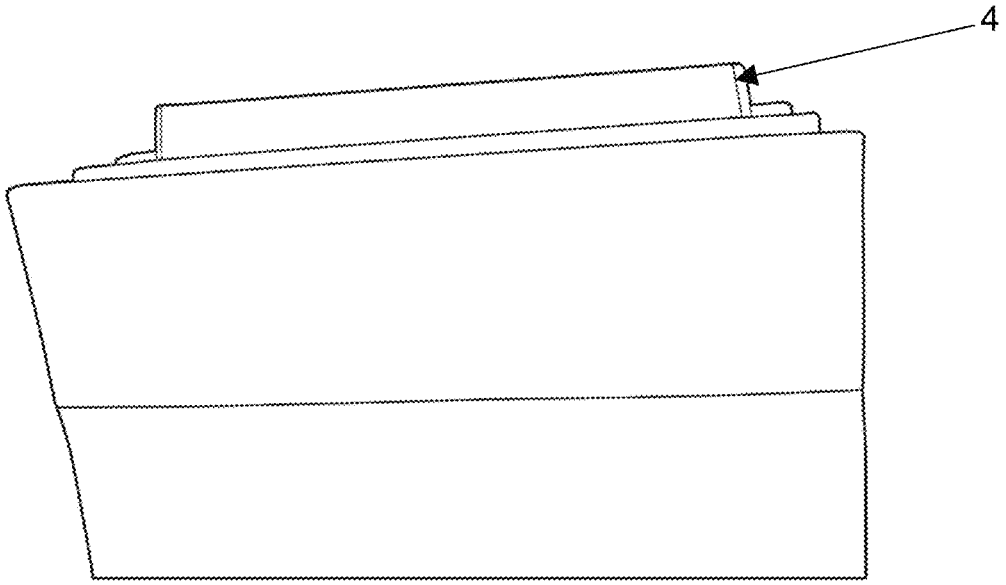
FIG. 30 shows the front view of the perceptive type device.
Figure 31:
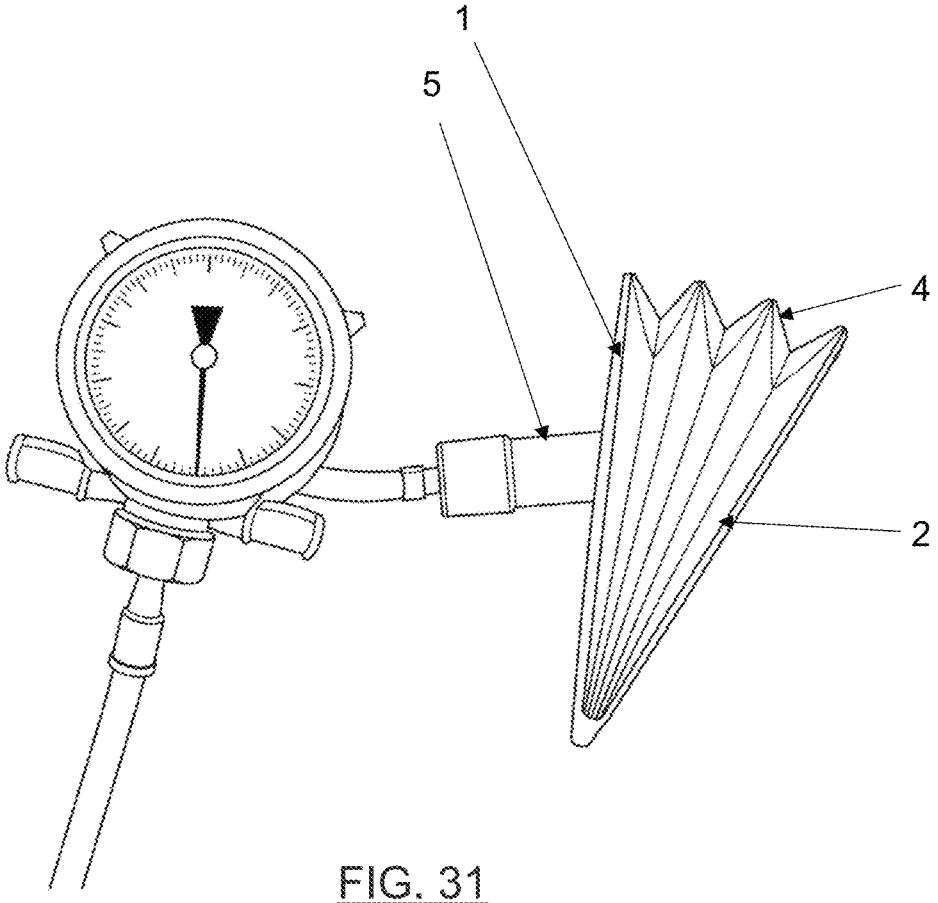
FIG. 31 shows the placement of the manometer on the device with mouthpiece and adapter.

In an alternative mode, the device is of the perceptive type, as it features a perceptual flap at the top of the last fold where the device ends in its posterior body (2), as shown in FIGS. 10 and 29. These figures display the side view of the posterior flap of the perceptive-type device in two modes, and FIG. 31 illustrates the placement of the manometer on the device with the mouthpiece and adapter.

This flap, preferably in green, approaches the patient's field of vision as the bellows close, thus indicating that the exercise is being performed correctly. The presence of this flap ensures that the patient notices the approaching green color, enhancing visual perception and indicating proper exercise execution. It also serves as a visual stimulus for repetition.

Figure 26:
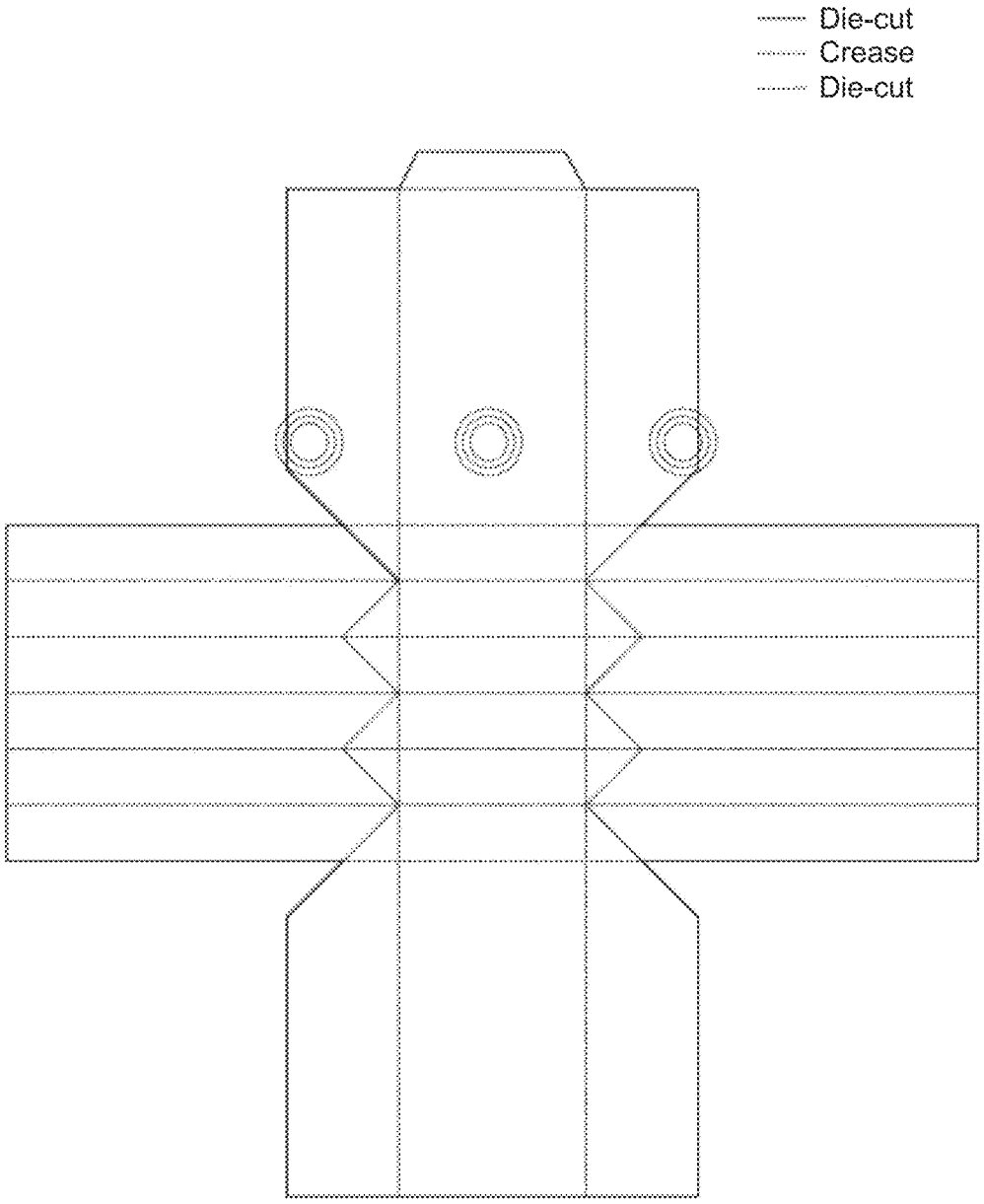
FIG. 26 shows the technical drawing of the die-cut for the rectangular device with 6 folds.
Figure 27:
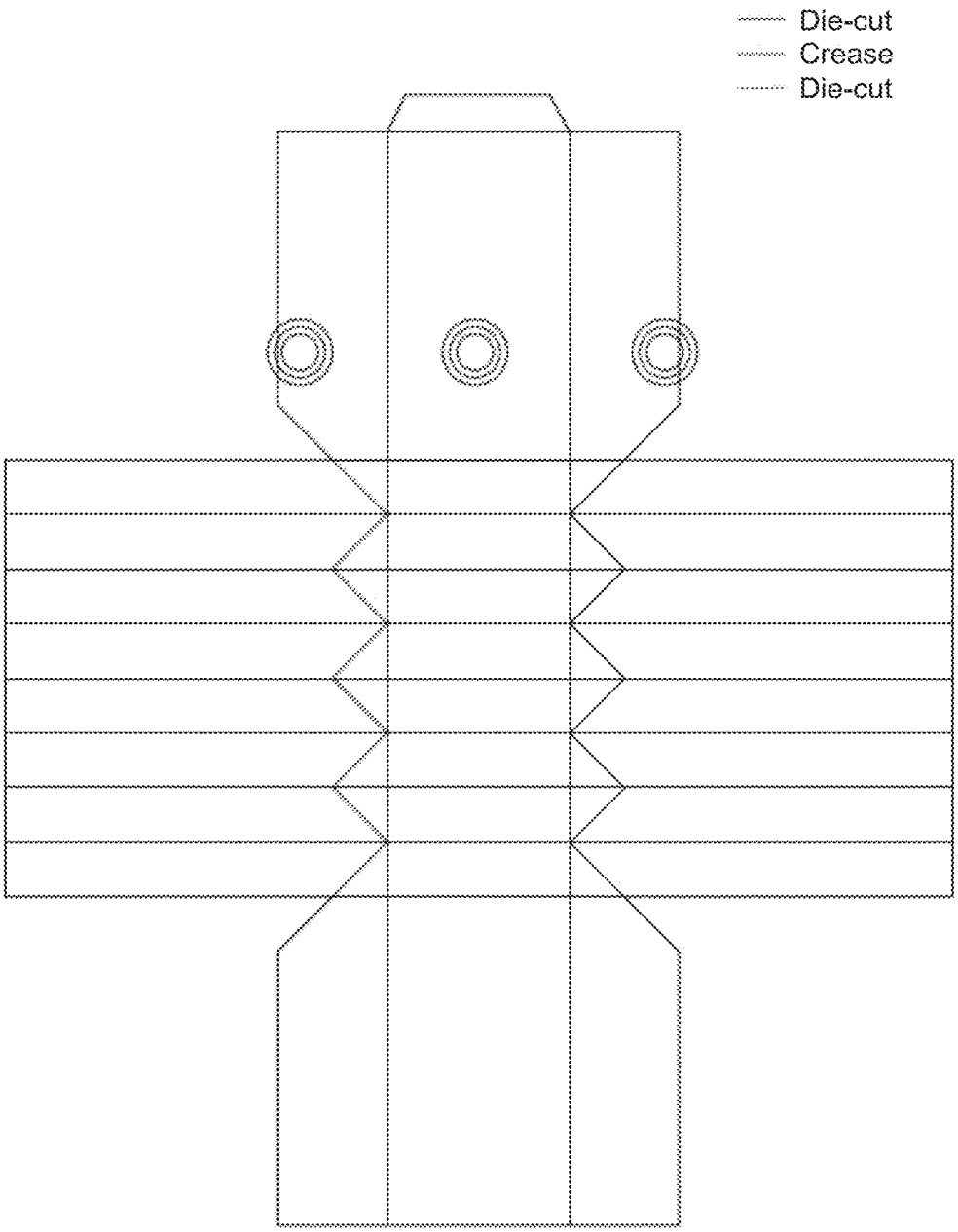
FIG. 27 shows the technical drawing of the die-cut for the rectangular device with 8 folds.
Figure 28:
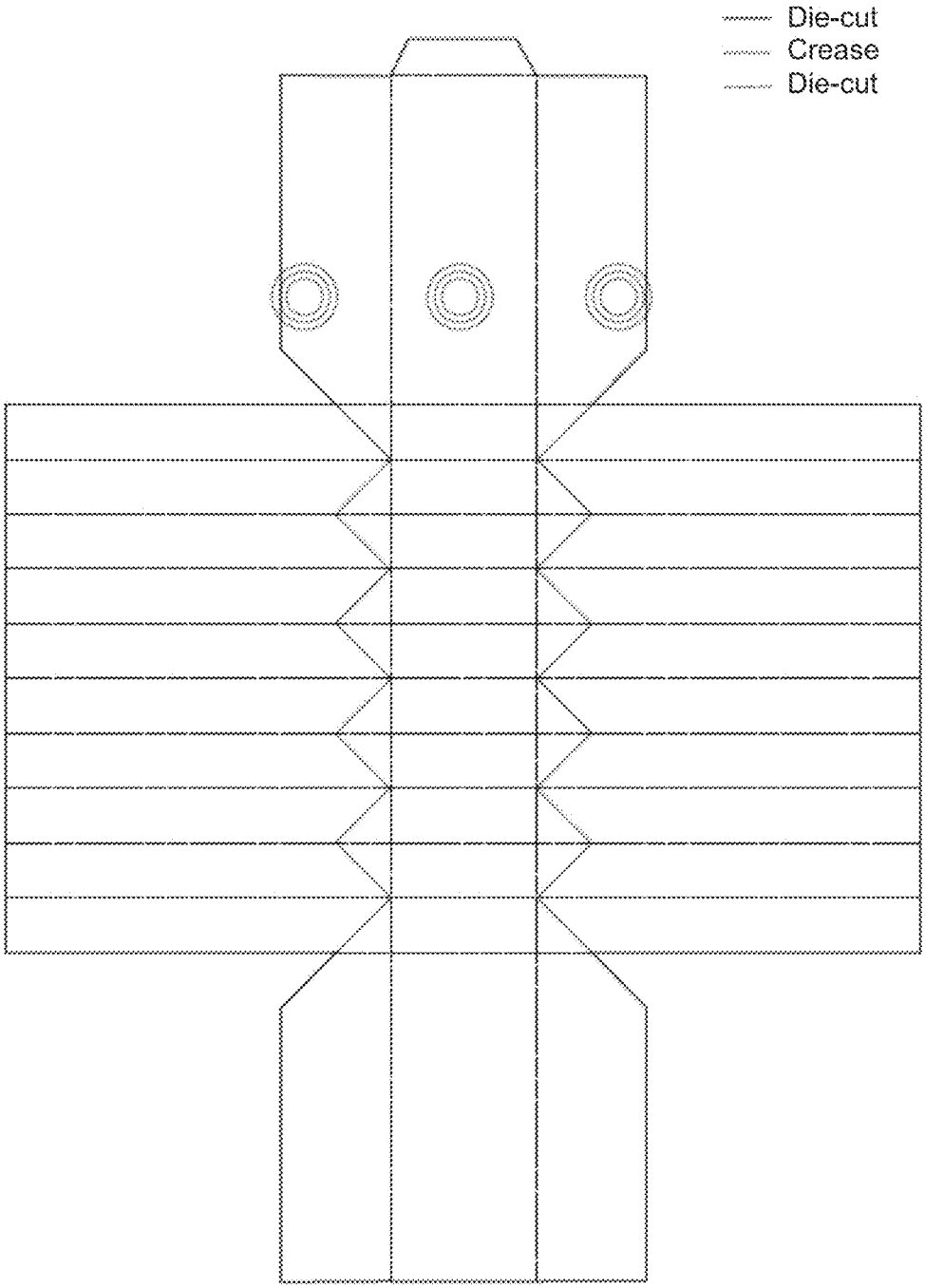
FIG. 28 shows the technical drawing of the die-cut for the rectangular device with 10 folds.

FIG. 26 shows the view of the technical drawing of the die-cut for the rectangular device with 6 folds. FIG. 27 shows the flattened view for the rectangular device with 8 folds. FIG. 28 shows the flattened view for the rectangular device with 10 folds. FIG. 29 shows the flattened view for the rectangular device with 9 perceptual folds, which uniquely features a flap, preferably green, that allows the patient to see the color as the bellows close with a full inspiration, indicating that the exercise is being performed correctly.

Example 1—Results Obtained From Manovacuometry Tests

The effectiveness of the exercises using the device of the present invention was measured by manovacuometry tests.

The methodology of the manovacuometry tests is as described below:

1. Calibrate the manometer—ensure that the analog pointer is at the zero position;
2. With the orotracheal tube adapter of the mouthpiece (5), manually perform the opening and closing movements on the anterior body (1) of the device, with the measurement on the manometer performed at the device's opening;
3. Conduct the reading directly on the manometer, with this reading performed in cm/H2O.

The experiment is performed on a rectangular prototype with 8 folds, made with the same paper in different grammages, as shown in FIG. 27 with a maximum reading of 50 cm/H2O on the manometer. FIG. 31 shows the placement of the manometer on the device with mouthpiece (5) and adapter.

TABLE 1

Results from the prototype test as shown in FIG. 27, set with a 20 mm opening using mouthpiece (5).

| | | | |
|---|---|---|---|
| Grammage | 180 | 200 | 240 |
| Level | Light | Moderate | Strong |
| Manovacuometry | 20 | 30 | 40 |

TABLE 2

Results from the rectangular prototype test as shown in FIG. 27, set with a 30 mm opening using mouthpiece (5).

| | | | |
|---|---|---|---|
| Grammage | 180 | 200 | 240 |
| Level | Light | Moderate | Strong |
| Manovacuometry | 10 | 20 | 30 |

This invention has been disclosed in this descriptive report in terms of its preferred embodiment. However, other modifications and variations are possible based on this description, and are still included within the scope of the invention as revealed here.

REFERENCE SIGNS

1—Anterior body;
2—Posterior body;

3—Orifice;

4—Accordion folds;

5—Mouthpiece;

6—Spring.

The invention claimed is:

1. An inspiratory incentive and exercise device comprising:

an accordion structure comprising a set of vertical and horizontal folds with angles between 35° and 110°, wherein the accordion structure has either all sides accordioned or one fixed side, forming a bellows from accordioned folds; the accordion structure defining a set of parallel lines having vertical creases corresponding to columns formed by the accordioned folds, on an outside of the inspiratory incentive and exercise device; and, together with horizontal lines, the accordioned folds create specific shapes, defining the dimensions of the said inspiratory incentive and exercise device and forming vertical lines and angled folds causing the retraction of said structure;

a posterior body closing the inspiratory incentive and exercise device at a lower end and supporting the bellows; and an anterior body closing the inspiratory incentive and exercise device at an upper end; the anterior body having a central orifice with a variable diameter configured to allow the passage of air, wherein with the inspiratory incentive and exercise device is made of paper.

2. The inspiratory incentive and exercise device according to claim 1, wherein the inspiratory incentive and exercise device is in the shape of a square, a rectangular, a triangular, or a pentagon.

3. The device according to claim 2, wherein, in a rectangular shape, the inspiratory incentive and exercise device, it has a length ranging between 5 mm to 250 mm, a total width ranging between 30 mm to 120 mm, a total height ranging between 40 mm to 200 mm, and a distance of 5 mm to 100 mm between the accordioned folds in the bellows, maintaining a proportionality of 1 space for every 2 accordioned folds, wherein the posterior body has a width ranging between 30 mm to 120 mm and a height ranging between 40 mm to 200 mm, and wherein the anterior body has a width ranging between 30 mm to 120 mm and a height ranging between 40 mm to 200 mm, and includes an orifice with a diameter ranging between 10 mm to 40 mm.

4. The inspiratory incentive and exercise device according to claim 2, wherein in a square shape the inspiratory incentive and exercise has a total length ranging between 5 mm to 250 mm, a total width ranging between 40 mm to 120 mm, and a total height ranging between 40 mm to 120 mm; with a distance of 5 mm to 100 mm between the accordioned folds in the bellows, maintaining a proportionality of 1 space for every 2 accordioned folds, wherein the posterior body has a width ranging between 40 mm to 120 mm and a height ranging between 40 mm to 120 mm, and wherein the upper body has a width ranging between 40 mm to 120 mm and height ranging between 40 mm to 120 mm, and includes the central orifice with a diameter ranging between 10 mm to 40 mm.

5. The inspiratory incentive and exercise device according to claim 2, wherein, in a triangular shape, the inspiratory incentive and exercise device has a total length ranging between 5 mm to 250 mm, a total width ranging between 40 mm to 140 mm, and a total height ranging between 50 mm to 160 mm; with a distance of 5 mm to 100 mm between the accordion folds in the bellows, maintaining a proportionality of 1 space for every 2 accordion folds, wherein the posterior body has a width ranging between 40 mm to 140 mm and a height ranging between 50 mm to 160 mm, and wherein the anterior body has a width ranging between 40 mm to 140 mm and a height ranging between 50 mm to 160 mm, and includes the central orifice with a diameter ranging between 10 mm to 40 mm.

6. The inspiratory incentive and exercise device according to claim 2, wherein, in a pentagonal shape, the inspiratory incentive and exercise device has a total length ranging between 5 mm to 250 mm, a total width ranging between 40 mm to 160 mm, and a total height ranging between 60 mm to 160 mm; with a distance of 5 mm to 100 mm between the accordion folds in the bellows, maintaining a proportionality of 1 space for every 2 accordion folds, wherein the posterior body has a width ranging between 40 mm to 160 mm and a height ranging between 60 mm to 160 mm, and wherein the anterior body has a width ranging between 40 mm to 160 mm and a height ranging between 60 mm to 160 mm, and includes the central orifice with a diameter ranging between 10 mm to 40 mm.

7. The inspiratory incentive and exercise device according to claim 1, further comprising a mouthpiece and a linear helical spring attached at its end and is connected to the inspiratory incentive and exercise device.

8. The inspiratory incentive and exercise device according to claim 7, wherein the mouthpiece has a diameter ranging between 10 mm to 40 mm and the mouthpiece is made of the same paper as the inspiratory incentive and exercise device.

9. The inspiratory incentive and exercise device according to claim 1, wherein the posterior body has dimensions from 30 mm to 200 mm and the central orifice has a diameter ranging from 10 mm to 40 mm.

10. The inspiratory incentive and exercise device according to claim 1, wherein the paper has a grammage ranging from 120 g/m$^2$ to 300 g/m$^2$, and wherein the paper is selected from bond paper, recycled paper, duplex, triplex, cardboard, kraft, or any other paper that accepts graphic creasing techniques.

11. The wherein the inspiratory incentive and exercise device according to claim 1, wherein a total length of the device varies between 5 mm to 250 mm.

12. The inspiratory incentive and exercise device according to claim 1, further comprising a perceptual flap at the top of the last accordioned fold where the inspiratory incentive and exercise device ends in the posterior body, wherein with the perceptual flap is green.

* * * * *